US006550470B2

(12) United States Patent
Liang

(10) Patent No.: US 6,550,470 B2
(45) Date of Patent: Apr. 22, 2003

(54) PORTABLE GAS BURNER WITH DETACHABLE REFLECTOR AND BASE

(76) Inventor: Hsin-Lien Liang, No. 80, Tzu Chung 2nd Street, Chung-Li City, Tao-Yuan Hsin (TW)

( * ) Notice: Subject to any disclaimer, the term of this patent is extended or adjusted under 35 U.S.C. 154(b) by 22 days.

(21) Appl. No.: 09/963,033

(22) Filed: Sep. 26, 2001

(65) Prior Publication Data

US 2003/0056782 A1 Mar. 27, 2003

(51) Int. Cl.[7] ..... F24C 15/22; F24C 3/00
(52) U.S. Cl. ..... 126/92 B; 126/85 R; 126/277
(58) Field of Search ..... 126/92 B, 92 R, 126/85 R, 92 AC, 9 R, 9 B, 39 E, 39 J, 277; 431/347, 154

(56) References Cited

U.S. PATENT DOCUMENTS 805,637 A * 11/1905 Craig et al. ..... 126/92 B
4,319,125 A * 3/1982 Prince ..... 126/92 B
5,964,233 A * 10/1999 Clark et al. ..... 135/16
6,164,273 A * 12/2000 Waters ..... 126/92 B
6,446,623 B1 * 9/2002 Resmo et al. ..... 126/92 R

FOREIGN PATENT DOCUMENTS

EP 0 976 979 A1 * 2/2000
FR 2 764 677 A1 * 12/1998

* cited by examiner

*Primary Examiner*—Henry Bennett
*Assistant Examiner*—Josiah Cocks
(74) *Attorney, Agent, or Firm*—Rosenberg, Klein & Lee

(57) ABSTRACT

A portable gas burner in which the base is comprised of a hollow disk-like shell and a plurality of sector plates detachably fastened to one another and to the periphery of the disk-like shell by screws; the reflector is comprised of a reflector disk and a plurality of sector plates detachably fastened to one another and to the periphery of the reflector disk by screw rods and wing nuts, which screw rods being respectively formed integral with the sector plates of the reflector.

1 Claim, 8 Drawing Sheets

PORTABLE GAS BURNER WITH DETACHABLE REFLECTOR AND BASE

BACKGROUND OF THE INVENTION

The present invention relates to a portable gas burner and, more specifically, to such a portable gas burner, which has a detachable reflector and a detachable base.

FIG. 9 shows a portable gas burner according to the prior art. This structure of gas burner 3 comprises a base 33, a burner body 31 supported on the base 33, and a reflector 32 suspended above the burner body 31. This structure of portable gas burner is functional, however it still has drawbacks. In order to effectively reflect the light and heat downwards from the burner body 31 and to support the portable gas burner stably on a flat surface, the reflector 32 and the base 33 must have a broad area (diameter). However, because the base 33 and the reflector 32 are not detachable, the portable gas burner occupies much storage space when not in use or during its delivery.

SUMMARY OF THE INVENTION

The present invention has been accomplished to provide a portable gas burner, which eliminates the aforesaid drawbacks. It is one object of the present invention to provide a portable gas burner, which has a detachable reflector and a detachable base. It is another object of the present invention to provide a detachable base and a detachable reflector for a portable gas burner that are inexpensive to manufacture. It is still another object of the present invention to provide a detachable reflector and a detachable base for a portable gas burner that have a strong structural strength. According to one aspect of the present invention, the base for the portable gas burner is comprised of a hollow disk-like shell and a plurality of sector plates detachably fastened to one another and to the periphery of the disk-like shell by screws. According to another aspect of the present invention, the reflector for the portable gas burner is comprised of a reflector disk and a plurality of sector plates detachably fastened to one another and to the periphery of the reflector disk by screw rods and wing nuts, which screw rods being respectively formed integral with the sector plates of the reflector. According to still another aspect of the present invention, the sector plates of the reflector each have a scrolled outer end portion and reinforcing ribs to reinforce the structural strength.

DETAILED DESCRIPTION OF THE PREFERRED EMBODIMENT

Figure 1:
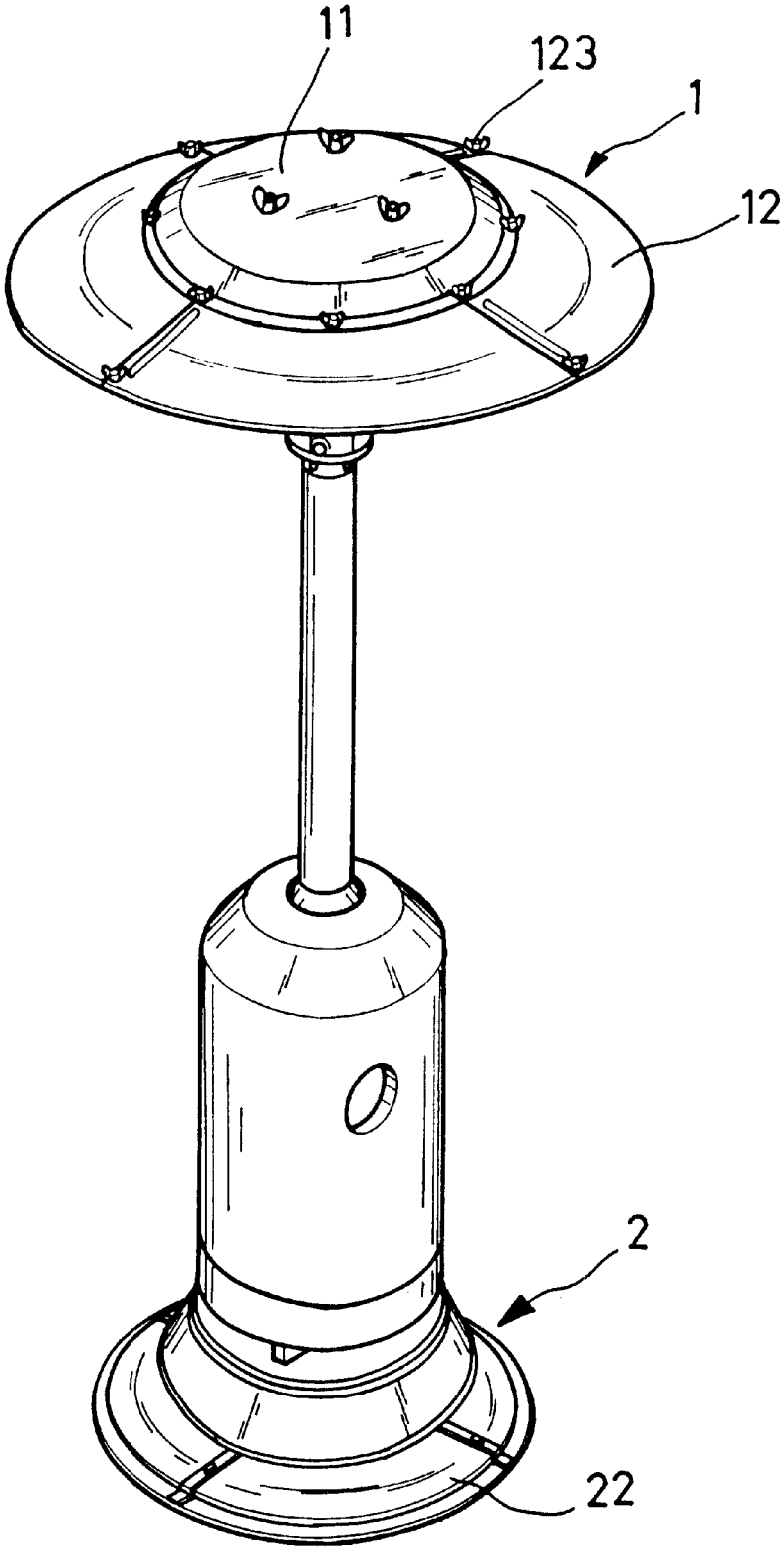
FIG. 1 is an elevational view of a portable gas burner constructed according to the present invention.
Figure 2:
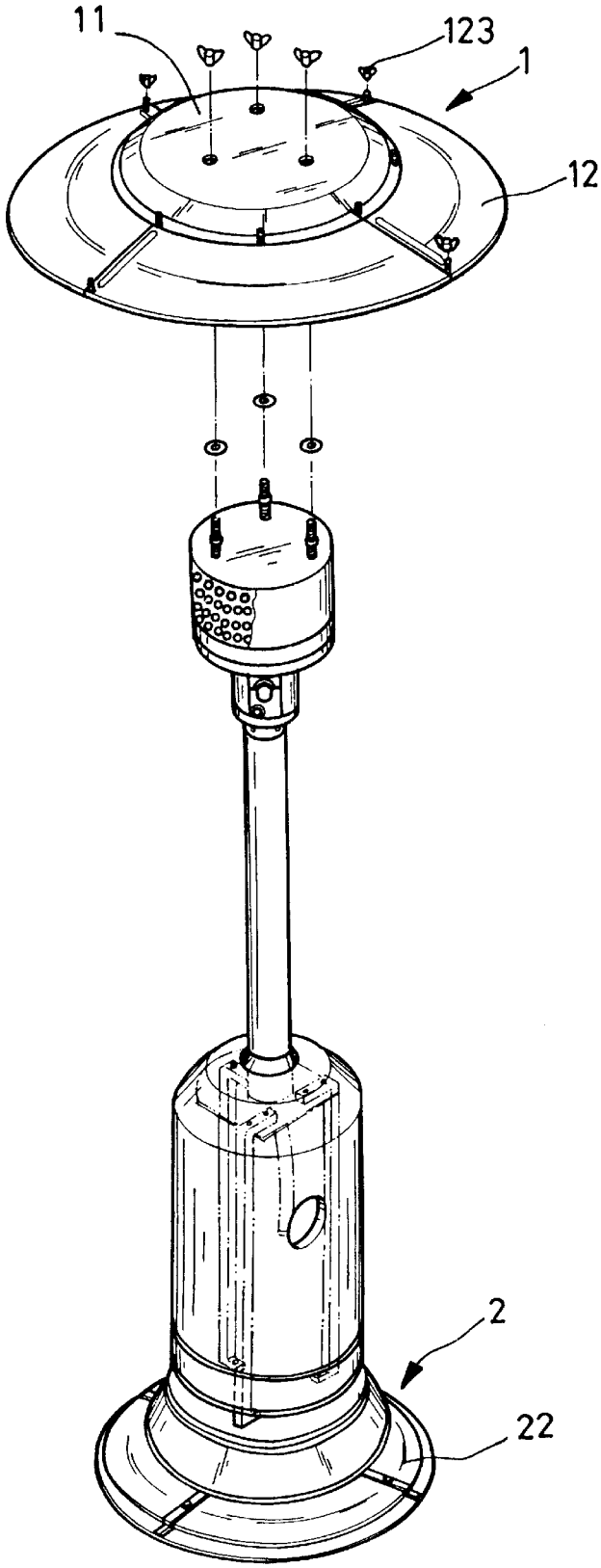
FIG. 2 is an exploded view of the portable gas burner shown in FIG. 1.

Referring to FIGS. 1 and 2, a portable gas burner is shown having a base 2, which supports the portable gas burner stably on a flat surface, and a reflector 1, which reflects light and light from the burner unit of the portable gas burner downwards. The reflector 1 and the base 2 are detachable.

Referring to FIGS. from 3 through 5 and FIGS. 1 and 2 again, the reflector 1 comprises a reflector disk 11, and a reflector rim R1 mounted around the reflector disk 11. The reflector disk 11 has a plurality of mounting holes 111 equiangularly spaced around the border thereof. The reflector rim R1 is comprised of a plurality of sector plates 12, each sector plate 12 having a plurality of upright mounting screws 121 and mounting holes 122. By means of inserting the respective upright mounting screws 121 into the respective mounting holes 111 and 122 and then threading respective wing nuts 123 onto the upright mounting screws 121, the sector plates 12 and the reflector disk 11 are fixedly fastened together.

Figure 6:
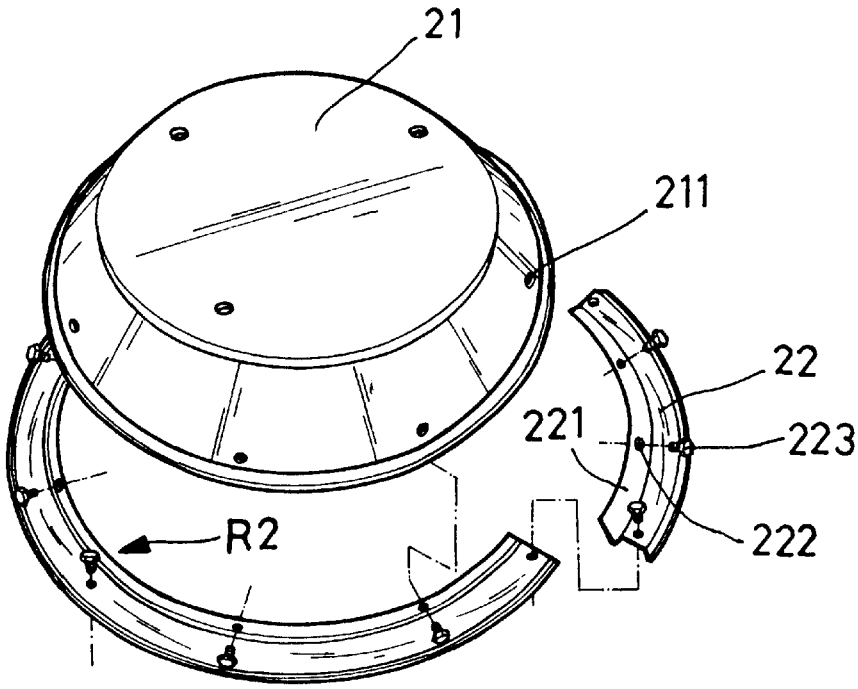
FIG. 6 is an exploded view of the base of the portable gas burner according to the present invention.
Figure 7:
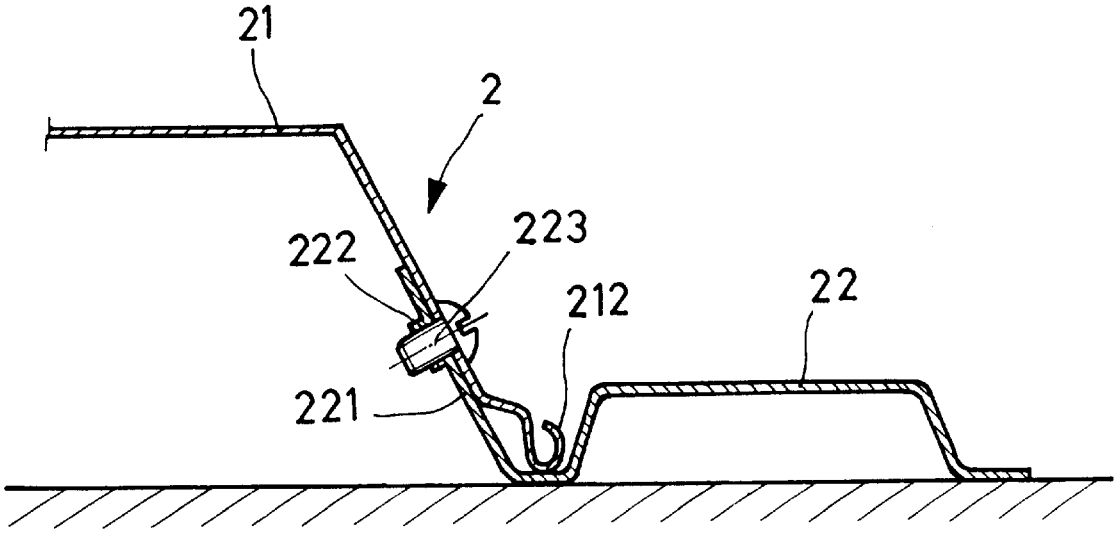
FIG. 7 is a sectional view in an enlarged scale of a part of the base of the portable gas burner according to the present invention.

Referring to FIGS. 6 and 7, the base 2 is comprised of a hollow, disk-like shell 21, and a rim R2 mounted around the disk-like shell 21. The disk-like shell 21 has a plurality of screw holes 211 equiangularly spaced around the periphery. The rim R2 is comprised of a plurality of sector plates 22, each sector plate 22 having an upward mounting flange 221 and a plurality of screw holes 222. Screws 223 are respectively fastened to the screw holes 222 and 211 to fixedly secure the sector plates 22 to one another and to the disk-like shell 21, keeping the sector plates 22 partially overlapped on one another and the upward mounting flange 221 connected to the periphery of the disk-like shell 21.

Figure 3:
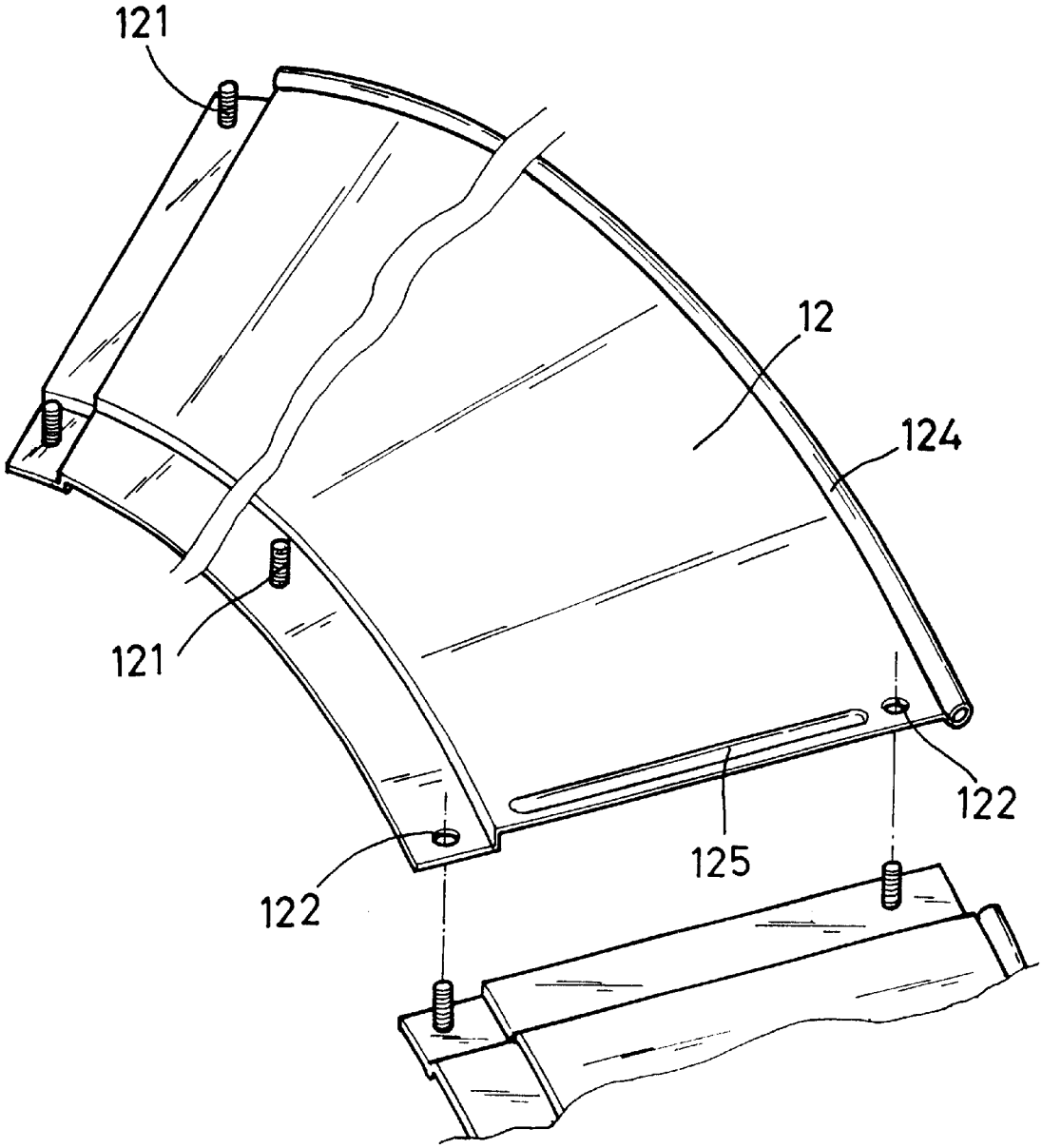
FIG. 3 is an exploded view in an enlarged scale of a part of the reflector rim of the reflector of the portable gas burner according to the present invention.
Figure 4:
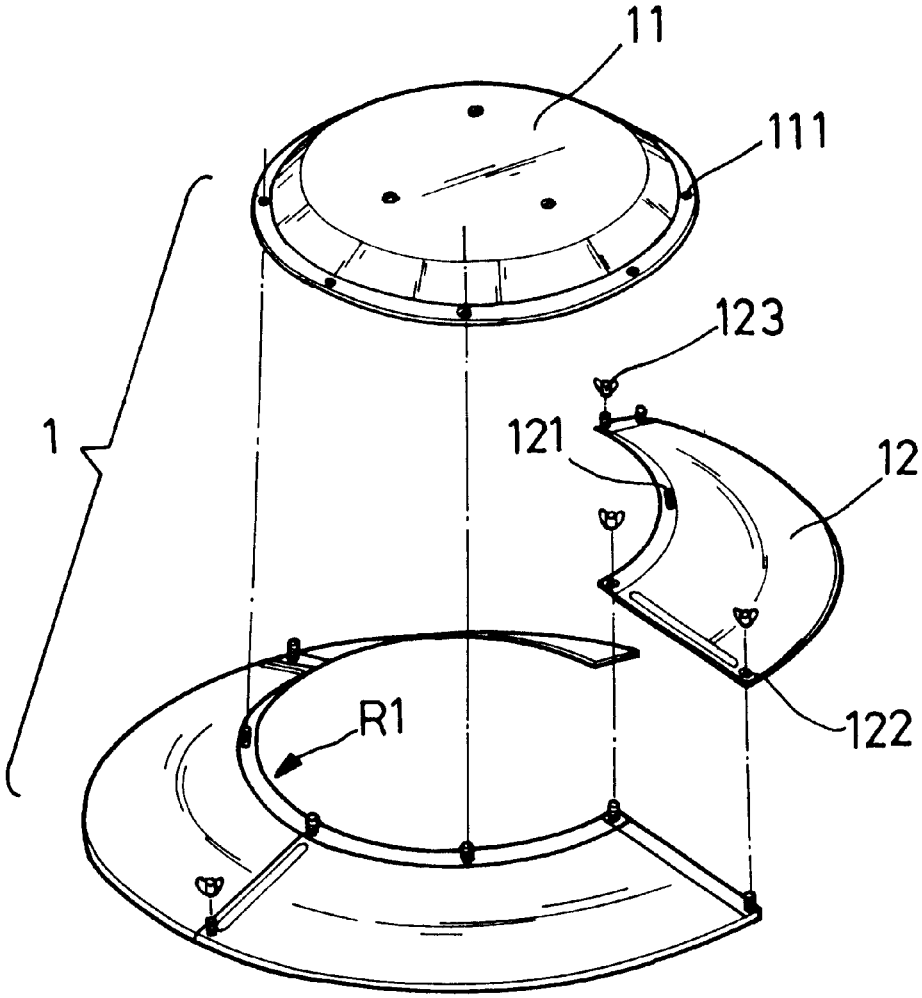
FIG. 4 is an exploded view of the base of the portable gas burner according to the present invention.
Figure 5:
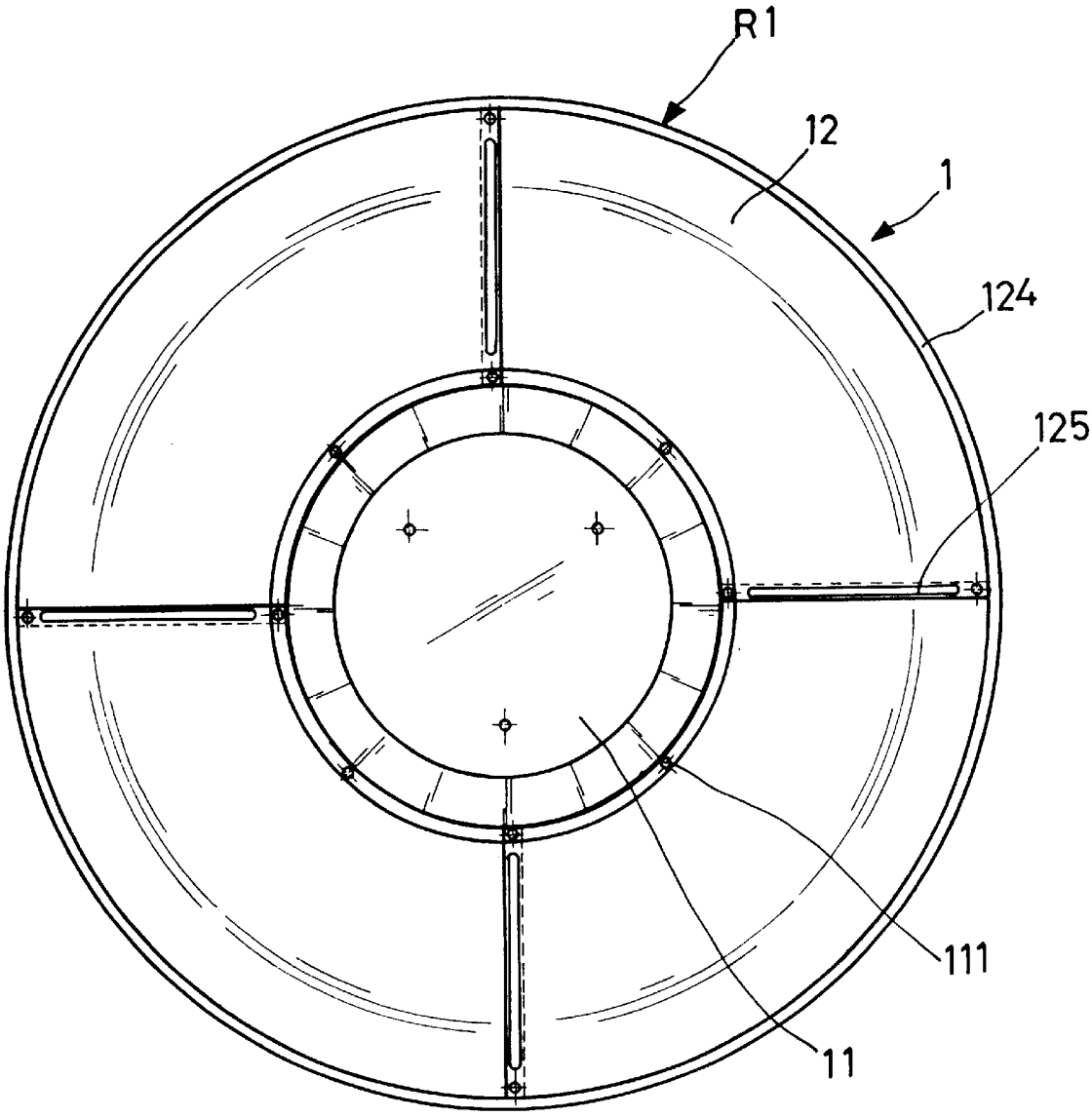
FIG. 5 is a top plain view in an enlarged scale of the reflector of the portable gas burner according to the present invention.

Referring to FIGS. 3 and 5 again, the sector plates 12 of the reflector 1 each have a scrolled outer end portion 124 and reinforcing ribs 125 that reinforce the structural strength of the respective sector plate 12.

Referring to FIG. 7, the disk-like shell 21 of the base 2 has a scrolled outer end portion 212.

Figure 8:
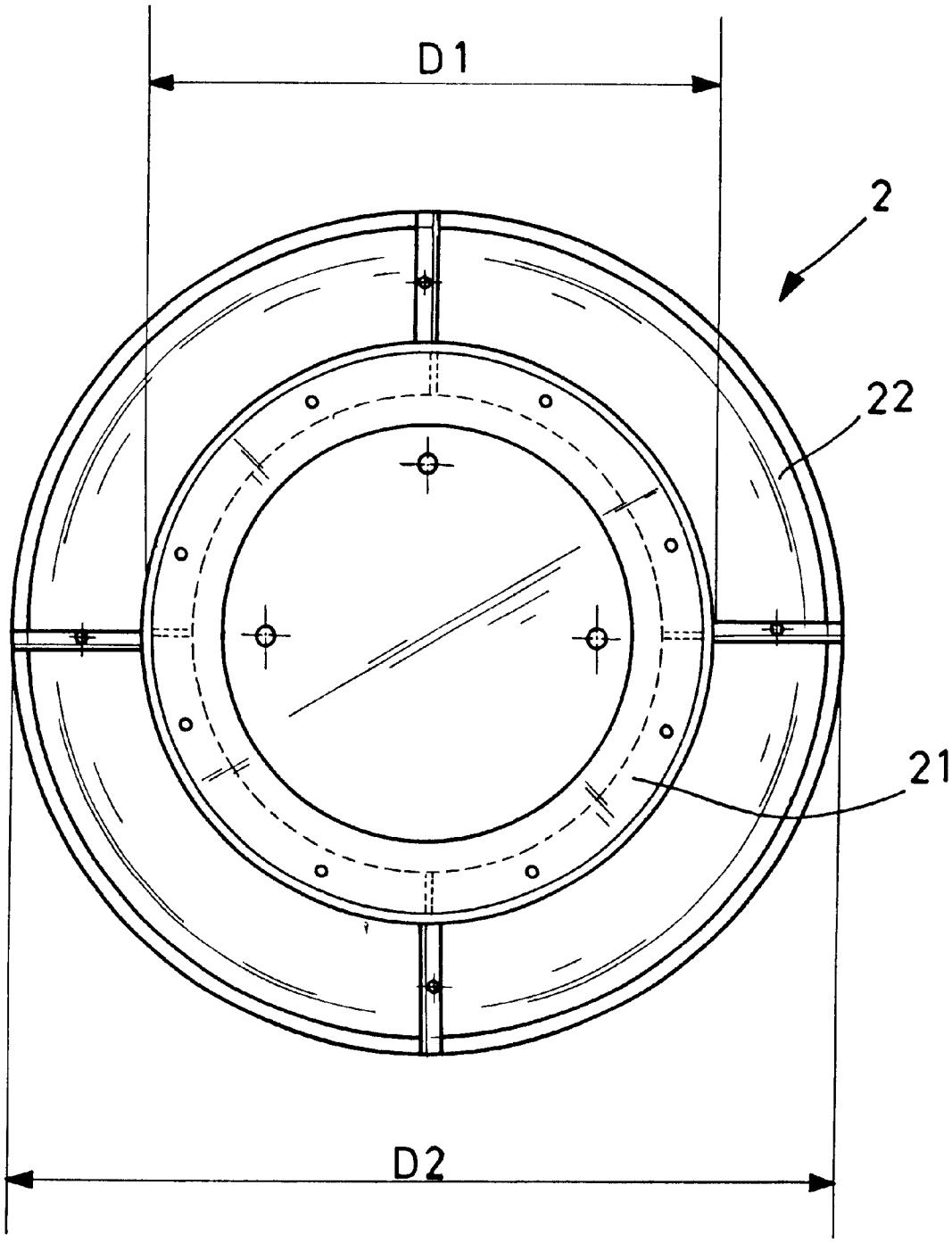
FIG. 8 is a top plain view of the base of the portable gas burner according to the present invention, indicating the diameter of the base before and after installation of the rim.
Figure 9:
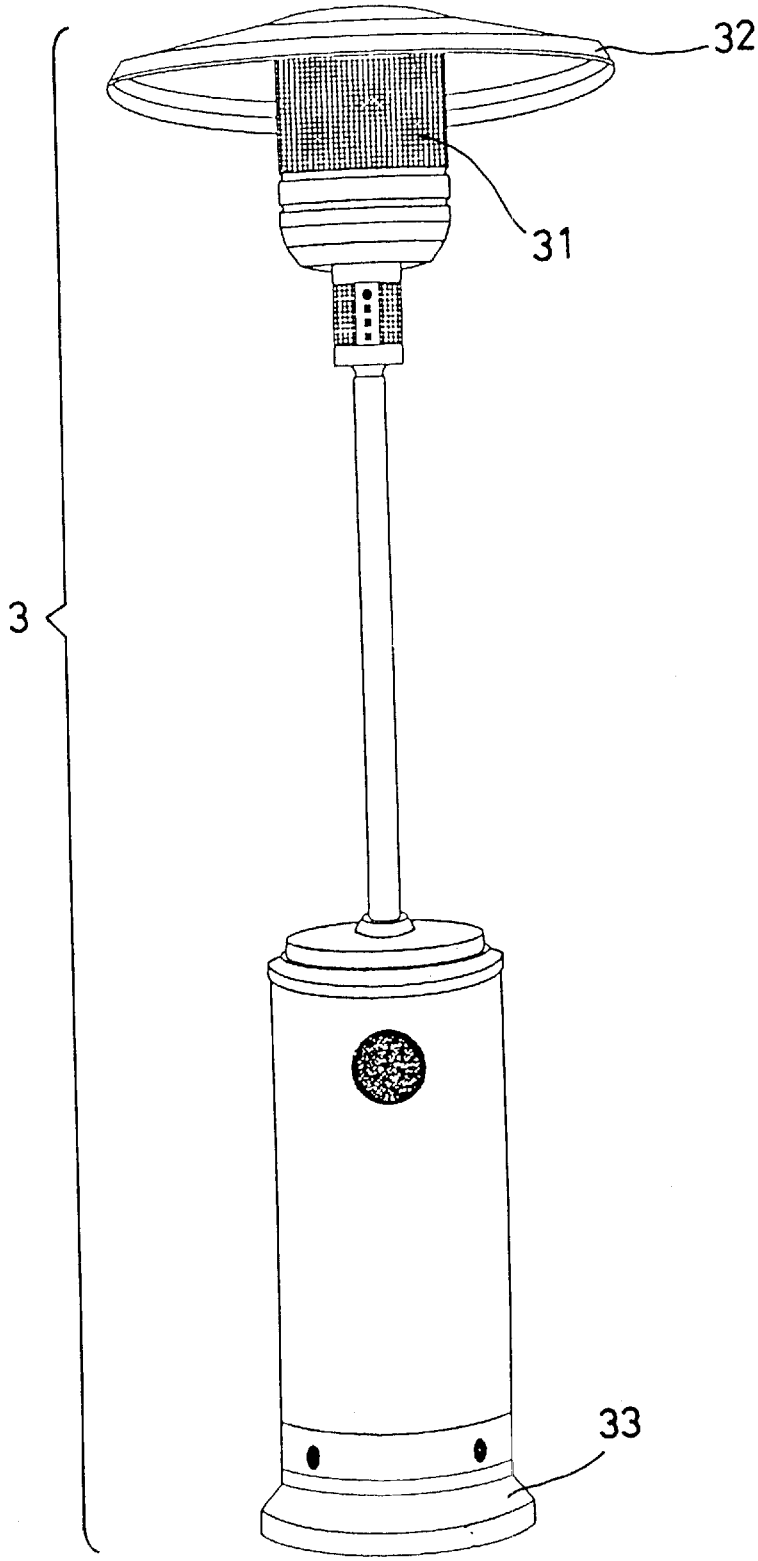
FIG.9 PRIOR ART
FIG. 9 is an elevational view of a portable gas burner according to the prior art.

Referring to FIG. 8, the diameter of the base 2 is increased from D1 (the diameter of the disk-like shell 21) to D2 when the sector plates 22 installed.

As indicated above, the reflector 1 and the base 2 are detachable. The parts of the reflector 1 and the base 2 are detached from one another and packed in a box to minimize space occupation during the delivery from the factory to the distributor. Because the reflector 1 and the base 2 are respectively formed of a number of parts, the small parts of the reflector 1 and the base 2 are easy to manufacture. When assembled, the broad supporting area of the base 2 supports the portable gas burner stably on a flat surface, and the reflector 1 provides a broad reflecting surface to reflect light and heat from the burner unit of the portable gas burner to a broad area.

A prototype of portable gas burner with detachable reflector and base has been constructed with the features of the annexed drawings of FIGS. 1~8. The portable gas burner with detachable reflector and base functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A portable gas burner of the type comprising a base, which supports the portable gas burner stably on a flat surface, and a reflector, which reflects light and light from the burner unit of the portable gas burner downwards, wherein:

said reflector comprises a reflector disk, said reflector disk having a plurality of mounting holes equiangularly spaced around the periphery thereof, a reflector rim mounted around said reflector disk, said reflector rim comprised of a plurality of sector plates respectively fastened to one another and fastened to said reflector disk, the sector plates of said reflector rim each having a plurality of upright screw rods, a plurality of mounting holes, a scrolled outer end portion, and reinforcing ribs, and a plurality of wing nuts respectively threaded onto said upright screw rods to fixedly secure said upright screw rods of one sector plate of said reflector to the mounting holes of another sector plate of said reflector and the mounting holes of said reflector disk;

said base comprises a hollow, disk-like shell, said disk-like shell having a plurality of screw holes equiangularly spaced around the periphery thereof and a scrolled outer end portion, a rim mounted around said disk-like shell, the rim of said base comprising a plurality of sector plates detachably fastened to one another and to said disk-like shell, the sector plates of said base each having an upward mounting flange and a plurality of screw holes, and screws respectively fastened to the screw holes of said disk-like shell and the sector plates of said base to fixedly secure the sector plates of said base to one another and to said disk-like shell.

* * * * *